United States Patent [19]

Voll

[11] 3,943,947

[45] Mar. 16, 1976

[54] TOE NAIL CLIPPER FOR DOGS AND OTHER ANIMALS

[76] Inventor: Samuel T. Voll, 308 S. 52nd St., Great Falls, Mont. 59405

[22] Filed: Jan. 9, 1975

[21] Appl. No.: 539,861

[52] U.S. Cl. ..... 132/73; 30/182

[51] Int. Cl.[2] ..... A45D 29/00

[58] Field of Search ..... 132/73, 75, 75.3, 75.4, 132/76.5; 30/182, 184, 242, 283

[56] References Cited

UNITED STATES PATENTS

| | | | |
|---|---|---|---|
| 205,088 | 6/1878 | Hollman | 132/74.5 |
| 2,518,991 | 8/1950 | Kolodnicki | 30/283 |
| 3,712,311 | 1/1973 | Hedu | 132/73 |
| 3,838,507 | 10/1974 | Clark | 30/242 |

*Primary Examiner*—G. E. McNeill

[57] ABSTRACT

This device consists primarily of a manually operated clipper having a plastic member with an integral and internally threaded sleeve which receives an adjustable and threaded plug, providing floor means which will vary in depth.

2 Claims, 3 Drawing Figures

TOE NAIL CLIPPER FOR DOGS AND OTHER ANIMALS

This invention relates to nail clipping devices, and more particularly to a toe nail clipper for dogs and other animals.

It is therefore the principal object of this invention to provide a toe nail clipper which will have plug means that will serve as a stop against the animal's nail, the stop means being adjustable so as to clip the animal's nails at a predetermined length.

A further object of this invention is to provide a toe nail clipper which will be of such structure so as to prevent injury to the animal when clipping the nails.

Other objects of the invention are to provide a toe nail clipper for dogs and other animals, which is simple in design, inexpensive to manufacture, rugged in construction, easy to use and efficient in operation.

These and other objects will be readily evident upon a study of the following specification and the accompanying drawing, wherein.

Figure 1:
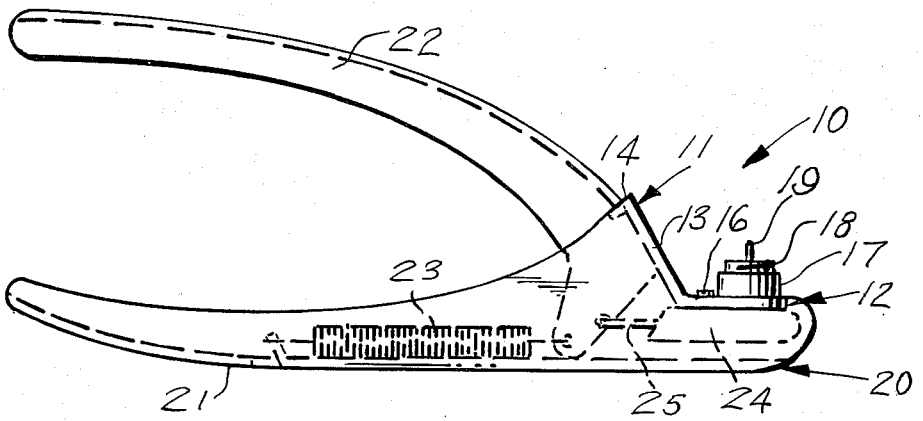
FIG. 1 is a fragmentary side view of an animal toe nail clipper comprising the present invention.
Figure 2:
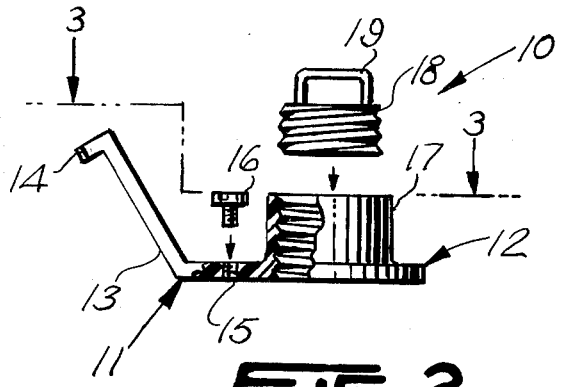
FIG. 2 is an enlarged exploded side view of the adjustable floor means of the device, the floor means being shown exploded and partly broken away.
Figure 3:
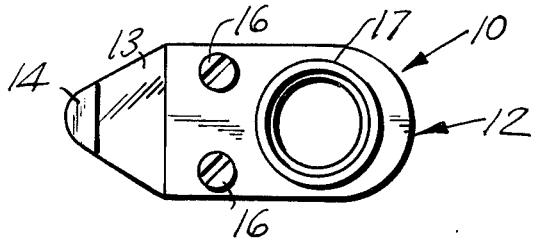
FIG. 3 is a view taken along the line 3—3 of FIG. 2.

According to this invention, a toe nail clipper 10 is shown to include a molded plastic device 11 consisting of a flat base 12 having an angular extension 13 which is terminated by a lip portion 14. A pair of openings 15 are internally threaded for receiving screw fasteners 16 which will render base 12 secure to clipper 10. Integral of device 11 within outwardly extending and internally threaded sleeve 17 which threadably receives a plug 18 having a handle 19 for the rotation thereof. The assembled device 11 provides adjustable floor depth for the animal's nails, thus enabling the user to clip the animal's nails at a predetermined length.

Device 11 is secured by said screw fastener 16 to the forward portion of frame 20 having a stationary handle 21. The movable handle 22 is pivotably carried within clipper 10 and a spring 23 provides return means for the movable cutter 24, (the stationary cutter not being shown for the sake of clarity). The movable cutter 24 is secured by lever 24 means to the end of handle 22 carried within frame 20.

It shall be noted that the device 11, instead of terminating at a point where the stationary toe nail cutting plate is exposed in clippers of the prior art, will now extend and completely encircle the stationary cutting plate. It is provided with a port within the sleeve 17, which is equal to the diameter of the stationary cutter. The animal's toe nail is inserted into this sleeve 17 and only a predetermined portion of the toe nail may be clipped.

In order to prevent injury to the animal, the animal's nail will contact a movable floor which is the bottom of the plug 18, the plug 18 being rotatable by means of the handle 19 for adjustment in the depth, the plug serving as stop means for the end of the animal's nail.

It shall further be noted that the device 11 may be adapted as a replacement for the plate member on clippers of the prior art.

What I claim is:

1. A toe nail clipper for dogs and other animals, comprising in combination, a frame consisting of a stationary lever and a movable lever, said movable lever being pivotally supported on said stationary lever, a plastic device being secured upon one end of said stationary lever, said plastic device comprising a flat base integral with a sleeve upon one side of said base, said sleeve having a simple axis which is perpendicular to the plan of said flat base, said sleeve having internal screw thread, a rotatable plug being externally screwthreaded and a gauge within said threaded opening of said sleeve, a handle upon one end of said plug or rotation of said plug within said sleeve, and opposite end of said plug forming a flat face against which an end of an animal toe nail is positioned, a movable cutter being positioned adjacent a flat side of said plastic device base, said movable cutter being attached to said movable lever whereby pivotable movement of said movable lever causes said movable cutter to slide respective to said plastic device base so as to cut said toe nail stopped at its end abainst said plug face.

2. The combination as set forth in claim 1 wherein a stationary cutter is supported by said stationary lever for cooperation with said movable cutter to cut said toe nail.

* * * * *